United States Patent [19]

Johnson

[11] Patent Number: 4,702,036

[45] Date of Patent: Oct. 27, 1987

[54] DOORWAY SAFETY GATE APPARATUS

[76] Inventor: Stanley A. Johnson, 2575 Maple Hill Dr., Brookfield, Wis. 53005

[21] Appl. No.: 870,550

[22] Filed: Jun. 4, 1986

[51] Int. Cl.[4] ..... E06B 3/68

[52] U.S. Cl. ..... 49/55; 49/57; 49/394

[58] Field of Search ..... 49/55, 58, 57, 399, 49/394; 256/73, 26

[56] References Cited

U.S. PATENT DOCUMENTS

| | | | |
|---|---|---|---|
| 139,232 | 5/1873 | Boughton | 160/225 |
| 141,677 | 8/1873 | Tuttle | 160/225 |
| 942,502 | 12/1909 | Jablonovsky | 49/55 |
| 2,662,242 | 12/1953 | Hess | 16/176 |
| 2,896,277 | 7/1959 | Halligan | 49/55 X |
| 4,149,342 | 4/1979 | Bowers | 49/55 |
| 4,465,262 | 8/1984 | Itri | 256/24 |
| 4,492,263 | 8/1983 | Gebhard | 160/228 |
| 4,566,222 | 1/1986 | Hatvany | 49/56 |
| 4,573,285 | 3/1986 | Jokel | 49/55 |
| 4,583,715 | 4/1986 | Wright | 49/55 X |
| 4,607,455 | 8/1986 | Bluem et al. | 49/55 |

FOREIGN PATENT DOCUMENTS

| | | |
|---|---|---|
| 1236542 | 6/1960 | France . |
| 2041051 | 9/1980 | United Kingdom . |

*Primary Examiner*—Philip C. Kannan

*Attorney, Agent, or Firm*—Robert T. Johnson

[57] ABSTRACT

Apparatus is disclosed to provide a safety gate comprised of two segments, which on being closed, the segments overlap each other and can be locked in this closed position. Each gate segment is mounted on hinges in turn fastened to doorway frame pillars. The overlapping gate segments allow for convenience of fitting various widths of door frames.

7 Claims, 17 Drawing Figures

(SECTION A-A)

(VIEW B-B)

(VIEW D-D)

(VIEW C-C)

DOORWAY SAFETY GATE APPARATUS

FIELD OF THE INVENTION

This invention pertains to a safety gate mounted in a doorway, and is of great value in protecting of babies, by not allowing them through doorways in which the gate is mounted. This invention can be identified as "doorway safety gate apparatus".

PRIOR ART PERTAINING TO THIS INVENTION

U.S. Pat. No. 139,232 to Boughton for "Nursery Gates"—This patent discloses an expandable gate which locks on one end.

U.S. Pat. No. 141,677 to Tuttle for "Nursery Gates'-'—This discloses two frames A and B joined together—gates locks on the gate end.

U.S. Pat. No. 4,492,263 to Gebhard for "Infant Security Door Gate Assembly". This gate is an assembly of two segments, expandable by sliding on telescoping rods.

UK Pat. No. 2,041,051 to Adams for "Baby Gates". This is for an adjustable width gate, hinged on one end and locking on the opposite end.

Other reference patents of record are: U.S. Pat. No. 942,502, French No. 1,236,542, U.S. Pat. Nos. 2,662,242, 4,465,262, and 4,566,222.

None of the above cited prior patents touch the invention disclosed in this application.

OBJECTS OF THE INVENTION

One of the objects of this invention is to disclose a doorway safety gate, mounted on a removable frame, adjustable to fit in any width doorway, said doorway safety gate comprised of two halves each of which is mounted on a removable frame such that the gate halves meet or overlap in the middle of the doorway, and the two halves then locked together.

Another object of this invention is to disclose a doorway safety gate, comprised of two halves, each half mounted on hinges on opposite sides of a removable frame, adjustable to fit in a door frame, and the gate halves overlap on closing the gates segments.

Another object of this invention is to disclose a doorway safety gate comprised of two halves, which meet or overlap when the gate is closed.

Another object of this invention is to disclose a doorway safety gate comprised of two gate halves, said gate halves mounted on opposite sides of an adjustable removable frame, to fit in various door frame widths by means of hinges consisting of downward pointing fingers or pins on edges of said gate halves, said fingers or pins fitting in pin bearing sockets mounted on vertical legs of said removable frame.

Another object of this invention is to disclose a doorway safety gate comprised of two halves, the gate halves mounted on opposite sides of a removable frame adjustable to fit in variable width door frames, the gate halves mounted on the frame by hinges of downward pointing finger pins attached to a vertical side of each gate half and said downward pointing finger pins fitting in pin bearing sockets mounted on vertical legs of the removable frame.

Another object of this invention is to disclose a doorway safety gate comprised of two halves, the gate halves mounted on opposite sides of a removable frame adjustable to fit in variable width door frames the gate halves mounted on the frame by hinges of downward pointing finger pins attached to a vertical side of each gate half and said downward pointing finger pins fitting in pin bearing sockets mounted on vertical legs of the removable frame.

Another object of this invention is to disclose an adjustable removable frame comprising two L shaped sections, the bases of the L shaped sections to have mounted thereon pin bearing sockets, said pin bearing sockets to accommodate gate hinge sections comprising downward pointing finger pins attached to the gate edge sections.

Another object of this invention is to disclose a doorway safety gate apparatus wherein the invention consists of gate segments mounted on hinges on gate vertical frame mounts and the gate vertical frame mounts are attached to doorway frame by means of fastening screws.

Figure 1:
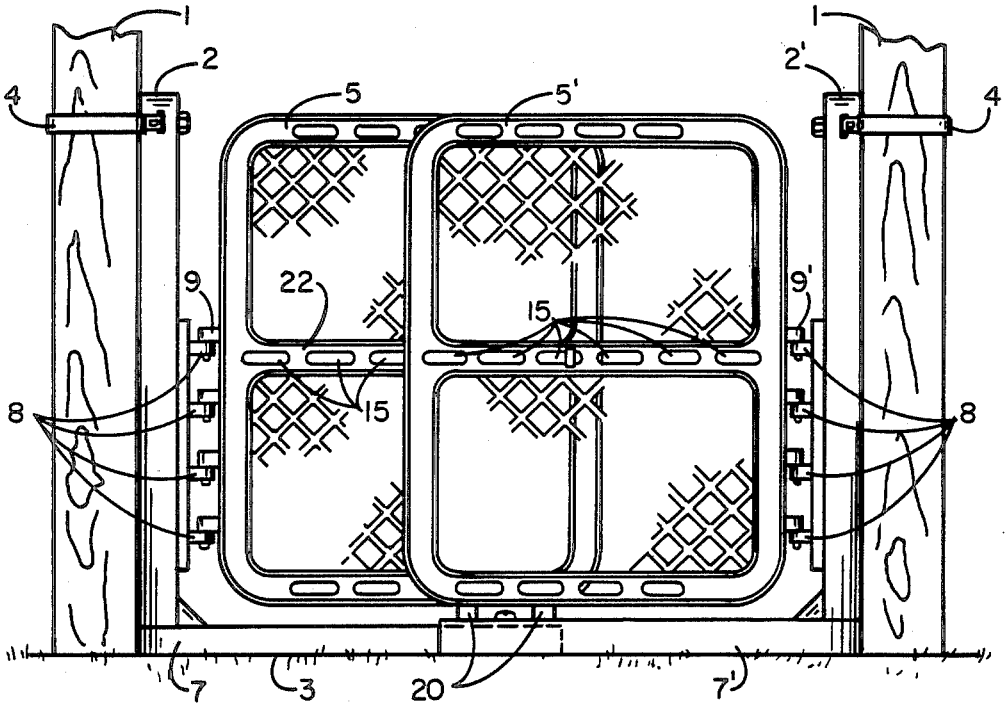
FIG. 1. Showing safety guard gate components in front elevation view.
Figure 2:
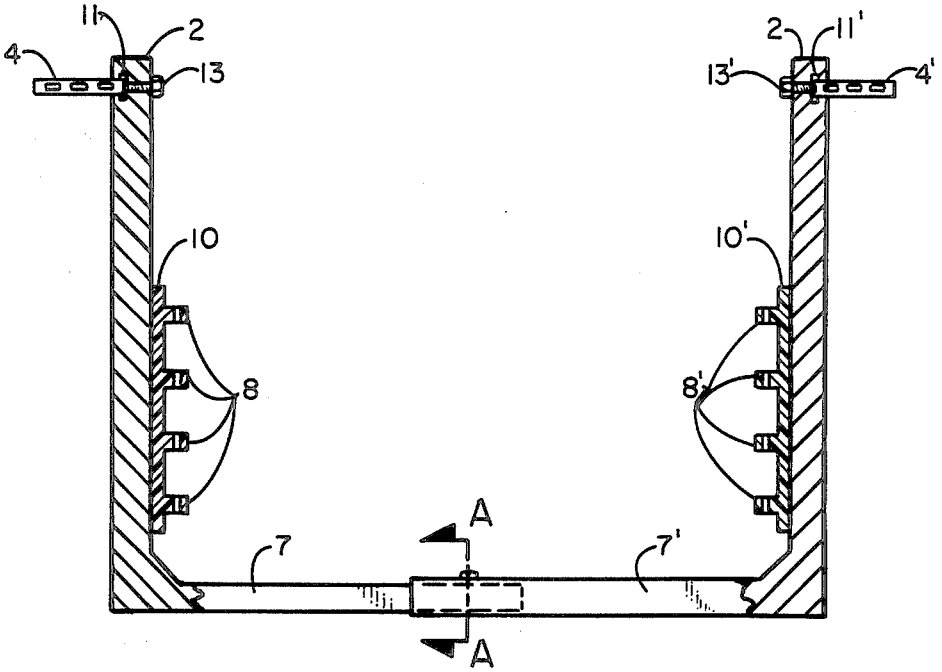

- 1. Doorway frame pillar
- 2. Gate vertical frame mounts
- 3. Doorway threshold
- 4. Vertical mount upper anchors
- 5. Gate half (segment)
- 5' Gate half (segment)
- 7,7' Threshold legs of gate vertical frame mounts
- 8. Hinge pin sockets
- 9. Hinge pins
- 15. Slots in gate center bar segment for inserting gate locking pin
- 20,20' Gate sag bumper
- 22,22' Center bar of gate segment FIG. 2. Expanded view of frame of safety gate mount.

Figure 3:
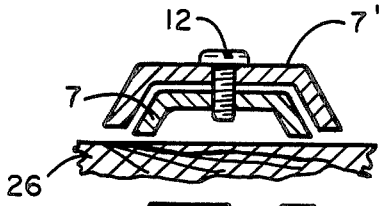

- 2. Gate vertical frame mounts
- 4. Vertical mount upper anchors
- 7,7' Threshold legs of gate vertical frame mounts
- 8. Hinge pin sockets
- 10. Hinge pin socket mount plate
- 11. Slot for vertical mount upper anchors
- 12. Fastening screw for threshold segments
- 13. Locking bolt for vertical mount anchor straps
- 26. Doorframe threshold FIG. 3. Expanded end elevation view of fitting of threshold of safety gate mount wherein: (This is section AA of FIG. 2)

Figure 4:
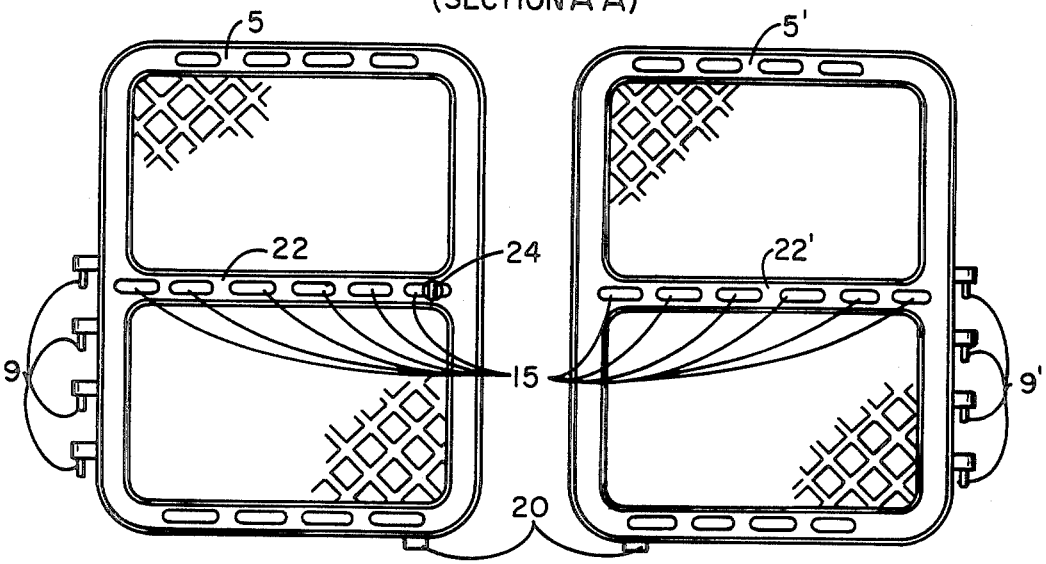
Figure 5:
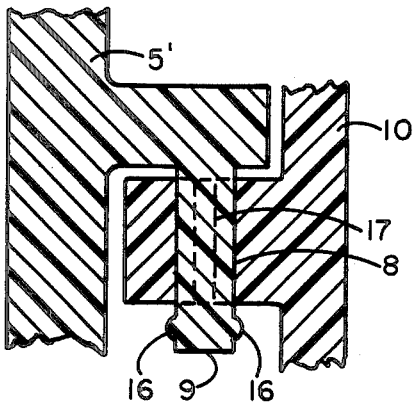

- 7,7' Threshold legs of gate vertical frame mounts
- 12. Fastening screw for threshold segments
- 26. Doorway frame threshold FIG. 4. Front elevation of gate halves or segments (shown in expanded view) wherein:

- 5. Gate half or segment
- 5' Gate half or segment
- 9. Hinge pins
- 15. Slots in gate center bar segment for inserting gate locking pin
- 20. Gate sag bumper
- 22,22' Center bars of gate segment
- 24. Gate locking pin FIG. 5. Enlarged elevation view of hinge pins fitting in hinge pin sockets wherein:

- 5. Gate half or segment
- 8. Hinge pin socket
- 9. Hinge pin

Figure 6:
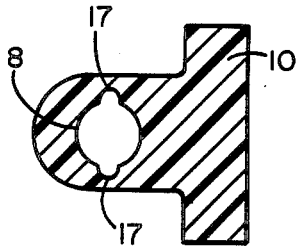
Figure 7:
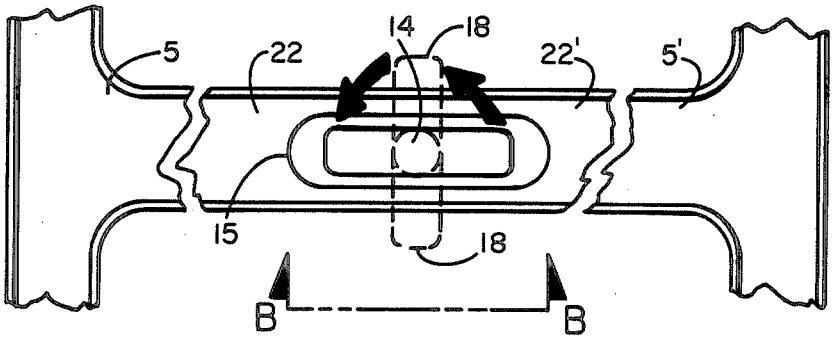
Figure 8:
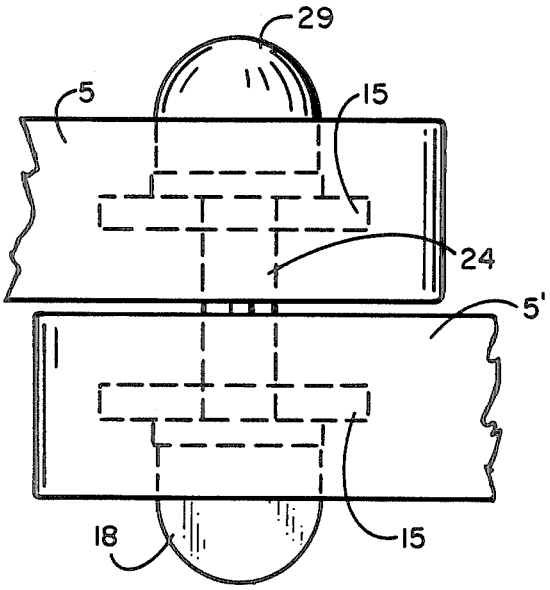
Figure 9:
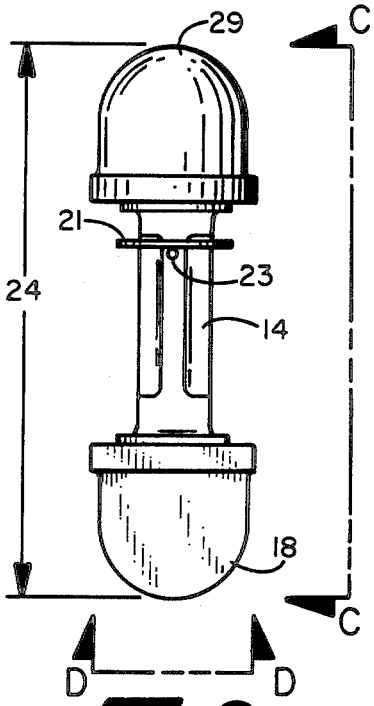
Figure 10:
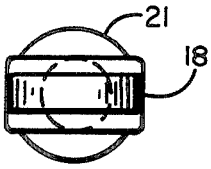
Figure 11:
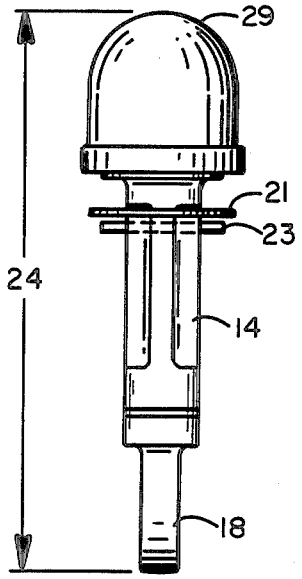
Figure 12:
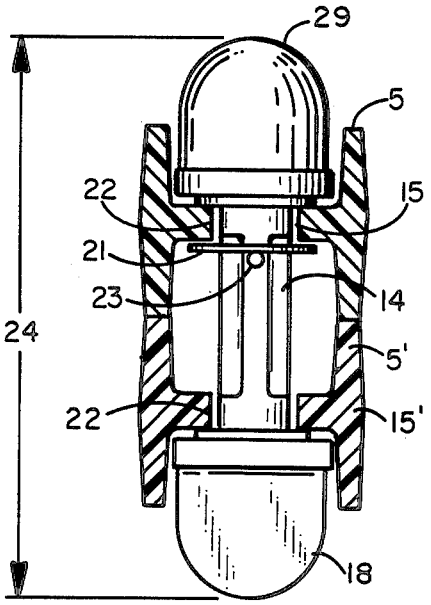
Figure 13:
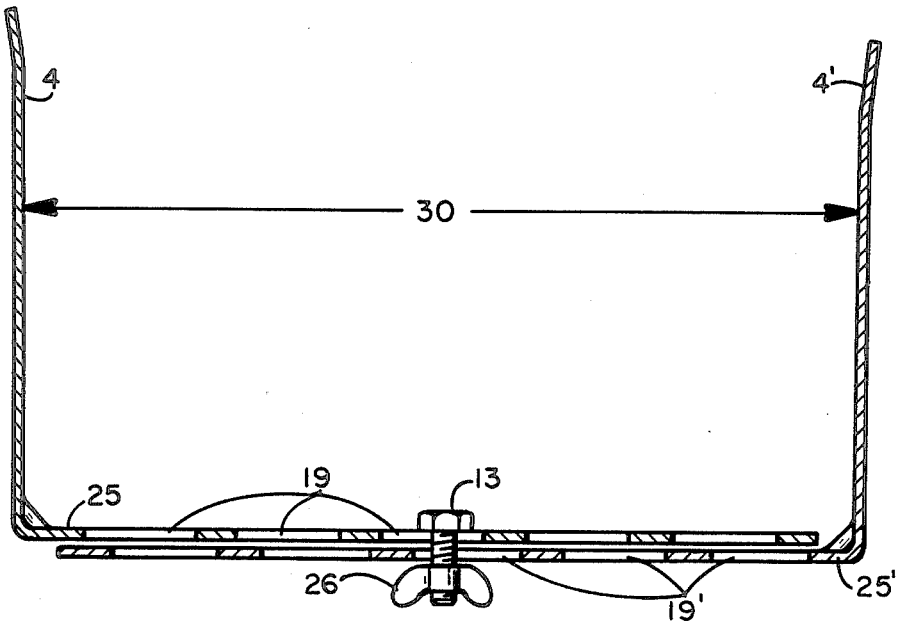
Figure 14:
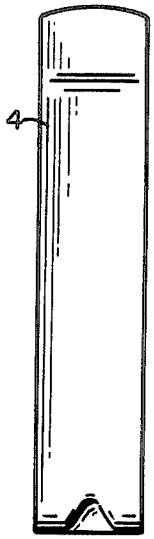
Figure 15:
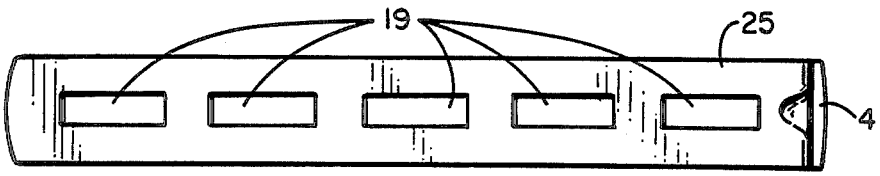
Figure 16:
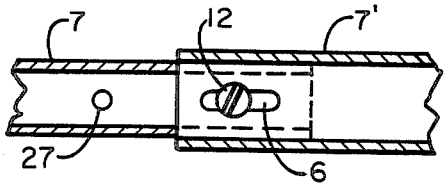

10. Hinge pin socket mount plate
16. Hinge pin key
17. Ghost lines of hinge pin leg groove keyway slot FIG. 6. Enlarged plan view of hinge pin socket wherein:
8. Hinge pin socket
10. Hinge pin socket mount plate
17. Hinge pin groove keyway slot FIG. 7. Enlarged elevation view of gate lock wherein:
5,5' Gate segments
14. Gate locking pin center section
15. Slots in the gate center bar segment for inserting gate locking pin
18. Gate locking pin flat head
22,22' Center bar of gate segment FIG. 8. Enlarged plan view of gate lock (Section B—B of FIG. 7):
5,5' Gate segments
15. Slots in gate center bar segment for inserting gate locking pin
18. Gate locking pin head
24. Gate locking pin
29. Gate locking pin round head FIG. 9. Enlarged plan view of gate locking pin wherein:
14. Gate locking pin center section
18. Gate locking pin flat head
21. Stop washer bearing
23. Gate locking pin cross pin
24. Gate locking pin
29. Gate locking pin round head FIG. 10. End view of gate locking pin and gate locking pin head wherein:
18. Gate locking pin flat head
21. Stop washer bearing FIG. 11. Enlarged plan view of gate locking pin wherein:
14. Gate locking pin center section
18. Gate locking pin flat head
21. Stop washer bearing
23. Gate locking pin cross pin FIG. 12. Cut away view of gate segments locked in position with gate locking pin wherein:
5,5' Safety gate segments
14. Gate locking pin center section
15,15' Slots in gate center bar segment for inserting gate locking pin
18. Gate locking pin flat head
21. Stop washer bearing
22. Center bar of gate segment
23. Gate locking pin cross pin
24. Gate locking pin
29. Gate locking pin round head FIG. 13. Plan view of edge of upper mount anchors of gate vertical frame mounts wherein:
4,4' Upper mount anchor straps
19,19 Slots in leg of upper mount anchor straps
23. Threaded bolt
26. Wing nut
25,25' Leg of upper mount anchor straps
30. Span for doorframe pillar FIG. 14. Elevation view of upper mount anchor straps wherein:
4' Flat view of upper mount anchor straps FIG. 15. Elevation view of:
4. Upper mount anchor straps
19. Slots in legs of upper mount anchor straps
25. Leg of upper mount anchor straps FIG. 16. Plan view of gate threshold wherein:
6. Slot in upper gate threshold
7,7' Threshold legs of gate vertical frame mounts
12. Fastening screw for threshold segments
27. Threaded screw hole in bottom gate threshold FIG. 17.
1. Doorway frame
2. Gate vertical frame mounts
8. Hinge pin sockets
10. Hinge pin socket mount plate
26. Doorframe threshold
28. Screws to attach hinge pin socket mount plate to doorway frame

DETAILED DESCRIPTION OF INVENTION

This invention is to disclose a doorway safety gate apparatus comprising two gate halves or segments, the halves to overlap on being closed and hinges mounted on outer vertical edge of each gate half, the hinges consisting of hinge pins pointed downward, and mounted on the edge of each gate half and hinge pin sockets mounted on the inside face of the door frame, and a keyway in said hinge pin sockets and hinge pin key segments on the bottom end of the hinge pin and a gate locking pin consisting of a gate locking pin center section and gate locking pin heads of rectangular cross section, one of said gate locking pin heads on each end of the gate locking pin center section and a gate locking pin cross pin and a stop washer bearing located between the cross pin and gate locking pin head, and the cross pin located on the gate locking pin center section to hold the stop washer bearing against center bar of gate segment and gate locking pin head opposite the stop washer bearing against opposite side of center bar of gate and the gate locking pin extending through matching slots of center bars in closed gate halves, and locking of the overlapping gate halves by a quarter rotation turn of the gate locking pin extending through the slots in gate center bars.

In the description which follows, the many legends in the various drawings are duplicates for each gate half or segment, and in view of this the description may mention legends with-without prime (') notation. Each gate half is similarly mounted.

This invention of a doorway safety gate guard comprises gate vertical frame mounts 2 fitting in doorway frame 1. Threshold legs of gate vertical frame mounts 7,7' are fastened together in overlapping position by means of fastening screw for threshold segments 7 and 7'. The threshold legs 7 and 7' straddle the door frame threshold 26, and threaded screw hole 27 is in leg 7 while slot in upper gate threshold 6 is in leg 7'. Legs of upper mount anchor straps 25 are inserted through slots in gate vertical frame mounts 11.

Legs of upper mount anchor straps 25 are fastened in slot for vertical mount upper anchors 11 by means of locking bolts for vertical mount anchor straps 13, the locking bolt extending through slots 19 in legs of anchor straps 25,25' which legs are in sliding contact prior to fastening by bolt 13.

The term "straps" as used in this discussion is meant to indicate for example, metal strap.

It is to be noted that vertical mount upper anchors 4 and 4' are each attached to their respective legs of upper mount anchor straps 25 and 25'. In actual assembly, legs of upper mount anchor straps 25 and 25' are in sliding contact with each other to adjust the span 30 for doorframe pillar 1 between 4 and 4' to securely fasten to doorway pillar frame 1. This is duplicated for each gate half.

Each gate half (segment) 5,5' has hinge pins 9 pointing downward, and mounted on the outer edges of each gate half. Hinge pin sockets 8 are attached to hinge pin socket mount plate 10, which in turn is mounted vertically on inner face of gate vertical frame mounts 2.

The gate halves 5 and 5', in closed position, overlap by various amounts which overlap is a function of doorway width. The closed overlapped gate halves or segments are locked in a closed position by means of gate locking pin 14 which fits in slot in gate segment 15. The slots in gate segment 15 are positioned in center bars of gate segments 22,22'.

Each gate half or segment 5,5' when mounted in position, hinge pins 9 are inserted in hinge pin sockets 8, hinge pin sockets 8 are mounted on hinge pin socket mount plate 10, and hinge pins 9 are held in hinge pin sockets 8 by means of hinge pin keys 16. The hinge pin keys 16 can be withdrawn through hinge pin socket 8 only when the hinge pins are aligned with hinge pin groove keyway slots 17. The hinge pin keys 16 are so aligned with the gate half 5 that the keys 16 can be aligned with hinge pin groove keyway slot 17 only when the gate halves are full open, or 90° from closed.

The gate halves 5,5' are locked in closed position by means of gate locking pin 24, consisting of gate locking pin heads 18 and 29 attached to gate locking pin center section 14. Gate locking pin cross pin 23 is mounted in gate locking pin shaft 14, and a stopwasher bearing 21, having a diameter larger than slots in gate segment 15. The gate locking pin head 18 is of oval or rectangular shape while gate locking pin round head 29 is round and of greater dimension than width of slot 15.

The narrow dimension of pin head 18 will easily slip through slots 15, in center bars of gate segments 22, but the longer dimension of pin head 18 will not slip through the slots 15. The gate halves or segments are then locked together in closed position on rotating the gate locking pin 24 by 90° on insertion of gate locking pin head 18 through slots 15.

Gate sag bumpers 20, are located on the bottom exterior end of each gate half 5,5'.

Figure 17:
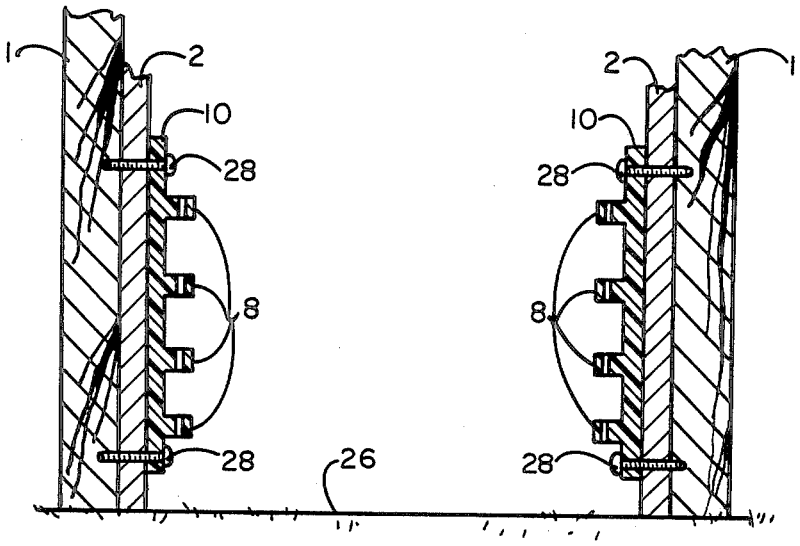

The preferred doorway safety gate apparatus as described above may be mounted in any doorway but as an alternate, the gate vertical frame mounts 2 may be anchored to the inside of doorway pillar frame 1 by means of screws 28 as shown in FIG. 17. By so mounting the gate vertical frame mounts 2 there is then no need for threshold legs of gate vertical frame mounts 7 and 7'.

The gate halves 5 and 5' are then mounted on the hinges as described above.

There are many different means for locking the closed gate segments 5 and 5' together such as a chain or a bolt inserted through slots in gate segments 15.

A preferred means for locking the gate segments 5 and 5' in a closed position is described below.

The doorway safety gate comprises gate locking means consisting of a gate locking pin 24 and pin heads 18 and 29 attached to each end of gate locking pin center section 14, and a gate locking pin cross pin 23 mounted near one end of the gate locking pin center section 14, and stopwasher bearing 21 in contact with the cross pin 23 so that the gate locking pin 24 is held in position perpendicular to and rotatable in a slot 15 in center bar 22. Pin head 29 if of greater dimension than slot in gate segment 15, and this gate locking pin is rotatable in slots 15. Pin head 18 is of rectangular or oblong configuration such that the short dimension can slip through slot in gate segment 15, and the long dimension or axis is greater than the short axis of slot in gate segment, and gate segments 5 and 5' are then locked together by turning or rotating gate locking pin 24, by 90°.

The lock mechanism for the gate in a closed position comprises the pin 24, having a square hexagon or round head 29 that is larger in dimension than the width of slots 15. The pin 24 is attached to one gate section by being inserted in slot 15, so that the head 29 is seated on surface of the cross bar, and the head is below the surface of flanges of the cross bar 22. A stop washer bearing 21 is placed on the gate locking pin center section 14, and positioned on the opposite surface of center bar from head 29 on gate segment 22. Stop washer bearing 21 is held in position by gate locking pin cross pin 23 inserted crossways in gate locking pin center section 14 to thus attach the gate locking pin 24 to gate cross bar and this gate locking pin 24 is perpendicular to the flat face of the gate. The gate sections 5 and 5' can then be locked in a closed position by entry of pin section and head 18 through slots 15 in gate segments 5 and 5' and the gate locking pin 24 is then rotated 90° to lock the two gate halves together.

Having described my invention, I claim:

1. Doorway safety gate apparatus wherein the improvement consists of:
   (a) two gate segments and gate vertical frame mounts
   (b) said segments to overlap when closed; and
   (c) hinges mounted on outer vertical edge of each gate segment,
   (d) said hinges consisting of
   (e) hinge pins pointed downward and mounted on edge of each gate segment, and said hinge pins of each gate segment mounted in
   (f) hinge pin sockets mounted on inside face of door frame pillars, and
   (g) keyways in said hinge pin sockets and
   (h) hinge pin key segments on bottom end of said hinge pins and
   (i) gate locking means comprising a rotatable locking pin in a
   (j) slot of center bar of each gate segment, and
   (k) said locking pin comprised of
   (l) pin heads attached to each end of locking pin center section and
   (m) one of said pin heads having a wide and narrow dimension and a
   (n) pin head having a base dimension greater than said slots of center bars of gate segments and
   (o) located on opposite end of said locking pin center section from pin head having a wide and narrow dimension.

2. Doorway safety gate apparatus wherein the improvement comprises:
   (a) two gate halves or segments
   (b) hinged on gate vertical frame mounts and
   (c) said halves to overlap on being closed, and
   (d) hinges mounted on outer vertical edge of each gate half,
   (e) said hinges consisting of
   (f) hinge pins pointed downward, and mounted on edge of each gate half, and
   (g) hinge pin sockets on gate vertical frame mounts mounted on inside face of door frame pillars, and (h) keyways in said hinge pin sockets, and
(i) hinge pin key segments on bottom end of said hinge pins, and
(j) a gate locking means consisting of a
(k) gate locking pin center section, and
(l) gate locking pin heads on each end of said gate locking pin center section, and
(m) a gate locking pin cross pin, and
(n) stop washer bearing locked between said cross pin and gate locking pin head, and
(o) said cross pin located on said gate locking pin center section to hold said stop washer bearing against center line page bar of gate segment, and
(p) gate locking pin head opposite said stop washer bearing against opposite side in slot of center bar of gate, and
(q) said gate locking pin having a wide and narrow dimension extending through matching slots in gate center bar segments, said overlapping gate halves.

3. Doorway safety gate apparatus of claim, 2 wherein gate segments are mounted on hinges on gate vertical frame mounts and said gate vertical frame mounts are attached to doorway frame pillar, by means of fastening screws.

4. Doorway safety gate of claim 2, wherein the improvement consists of:
(a) two gate segments mounted on hinges on vertical frame mounts
(b) gate locking pin mounted in slots in gate center bar segments of two overlapping gate segments
(c) pin heads attached to each end of locking pin center section
(d) one of said pin heads having a wide and narrow dimension and
(e) pin head located on opposite end of said locking pin center section, from pin head having a wide and narrow dimension, having a base dimension greater than slot narrrow dimension and
(f) stop washer bearing on opposite side of said slot, in contact with pin head having a greater dimension than slot narrow dimension and
(g) cross pin mounted perpendicular to long axis of said locking pin center section and
(h) in contact with said stop washer bearing on the surface opposite said slot and
(i) gate locking pin extending through said slots in center bar gate segments is rotatable on its long axis.

5. Doorway safety gate apparatus of claim 2 wherein further improvement consists of gate sag bumpers attached to bottom outer edges of each gate segment, said gate sag bumpers to contact gate threshold when gate is in closed position.

6. Doorway safety gate apparatus of claim 2 wherein gate segments are mounted on hinges on gate vertical mounts and said gate vertical frame mounts are attached to adjustable horizontal threshold legs of gate vertical frame mounts and vertical mount upper anchors are fitted in slot for vertical mount upper anchors in said gate vertical frame mounts, and said vertical mount upper anchors are adjusted to doorway frame pillar by means of adjustable screw slots.

7. Doorway safety gate apparatus of claim 6, the improvement consisting of adjustable threshold legs attached to vertical frame mounts of gate segments and said threshold legs to overlap and held rigid by means of a screw attaching the overlapping threshold segments to each other.

* * * * *

UNITED STATES PATENT AND TRADEMARK OFFICE

CERTIFICATE OF CORRECTION

PATENT NO. : 4,702,036

DATED : October 27, 1987

INVENTOR(S) : Stanley A. Johnson

It is certified that error appears in the above-identified patent and that said Letters Patent is hereby corrected as shown below:

Column 7, line 9, Claim 2, "locked" should read --located--.

Signed and Sealed this

Seventeenth Day of April, 1990

*Attest:*

HARRY F. MANBECK, JR.

*Attesting Officer*

*Commissioner of Patents and Trademarks*